US005379533A

United States Patent [19]

Swartz

[11] Patent Number: 5,379,533

[45] Date of Patent: Jan. 10, 1995

[54] FLUID FILLED AMUSEMENT OR ATTENTION ATTRACTING ARTICLE FOR ATTACHMENT TO FOOTWEAR

[75] Inventor: Eric Swartz, Malden, Mass.

[73] Assignee: Converse Inc., North Reading, Mass.

[21] Appl. No.: 803,024

[22] Filed: Dec. 6, 1991

[51] Int. Cl.[6] ..... A43B 23/24; A43C 3/00

[52] U.S. Cl. ..... 36/136; 40/636

[58] Field of Search ..... 36/136, 132, 28, 88, 36/153, 71, 29, 25 R; 2/244, 115; 40/586, 636, 329, 326, 661

[56] References Cited

U.S. PATENT DOCUMENTS

| | | | |
|---|---|---|---|
| 2,889,639 | 6/1959 | Rudine | 36/25 R |
| 4,458,430 | 7/1984 | Peterson | 36/153 |
| 4,577,417 | 3/1986 | Cole | 36/28 |
| 4,610,102 | 9/1986 | Hill | 36/136 |
| 4,712,319 | 12/1987 | Goria | 36/136 |
| 4,744,157 | 5/1988 | Dubner | 36/71 |
| 4,766,682 | 8/1988 | Malloy, III | 36/136 |
| 4,834,688 | 5/1989 | Jones | 2/115 |
| 4,837,960 | 6/1989 | Skaja | 36/136 |
| 4,843,741 | 7/1989 | Yung-Mao | 36/114 |
| 4,974,345 | 12/1990 | Yung-Mao | 36/114 |
| 4,993,429 | 2/1991 | Krinsky | 36/153 |
| 5,050,319 | 9/1991 | Perotto et al. | 36/88 |

OTHER PUBLICATIONS

9110376 Jul. 1991 PCT Seymour.

*Primary Examiner*—Steven N. Meyers

*Attorney, Agent, or Firm*—Rogers, Howell & Haferkamp

[57] ABSTRACT

A fluid filled amusement or attention attracting article for attachment to footwear is comprised of at least one fluid filled chamber secured to the exterior of the footwear. The fluid filled chamber is constructed of a flexible transparent material and contains a fluid that is visible from the exterior of the chamber. The liquid is brightly colored and serves as an attention attracting device for attracting the attention of motorists to a pedestrian wearing the shoe employing the article. The fluid filled chamber also serves as an amusement device where the fluid contained in the chamber is caused to flow through the chamber by manipulation of the flexible chamber sidewalls and the flow of fluid is both visible and sensed by touch.

25 Claims, 1 Drawing Sheet

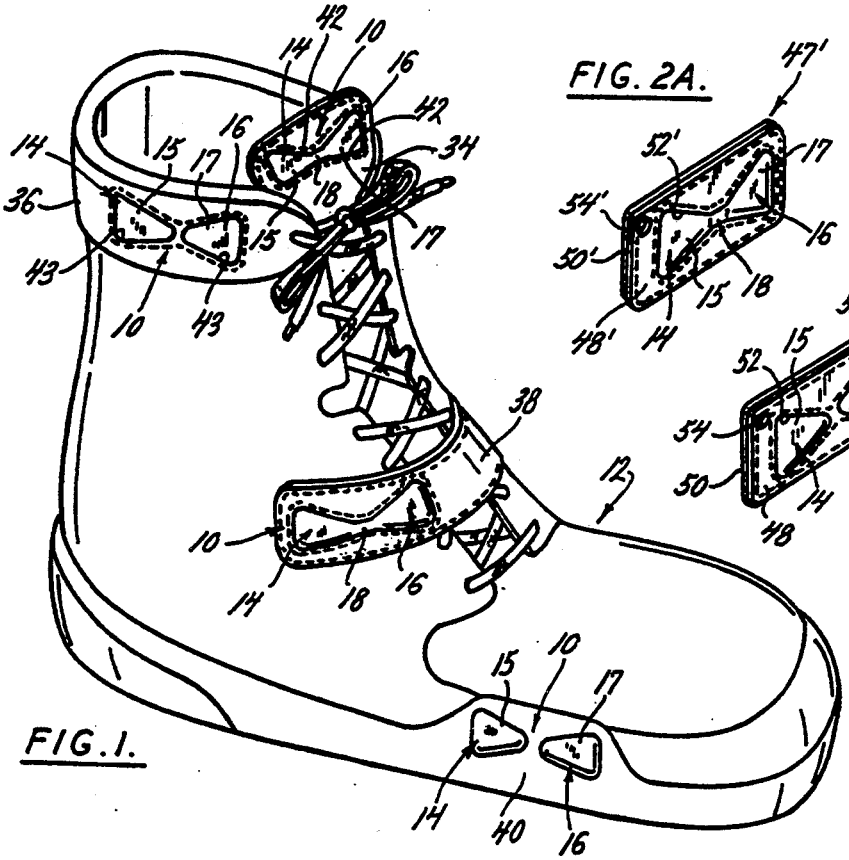
FIG. 1.
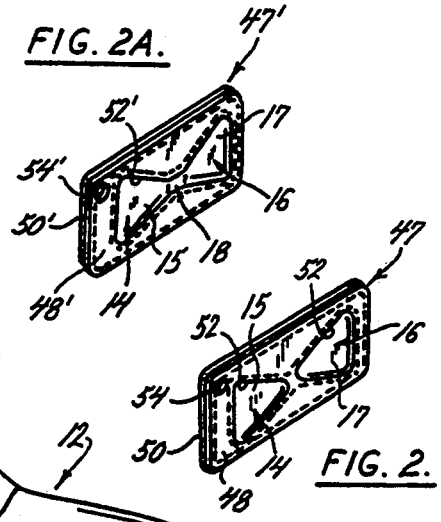
FIG. 2A.
FIG. 2.
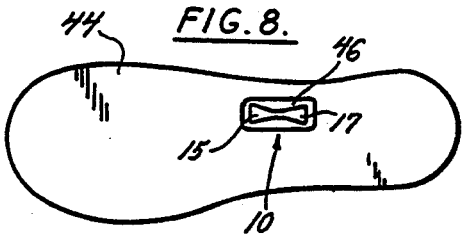
FIG. 8.
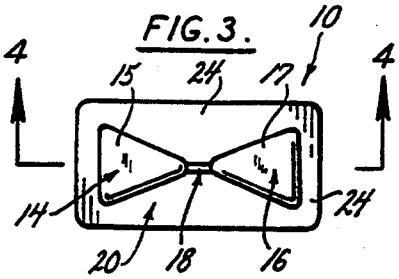
FIG. 3.
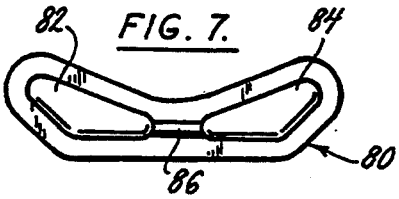
FIG. 7.
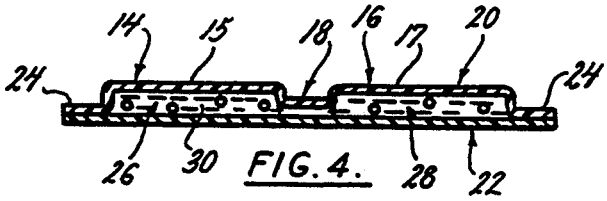
FIG. 4.
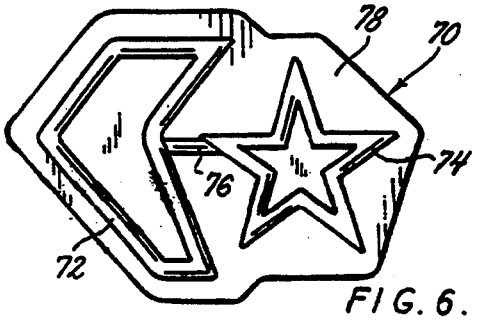
FIG. 6.
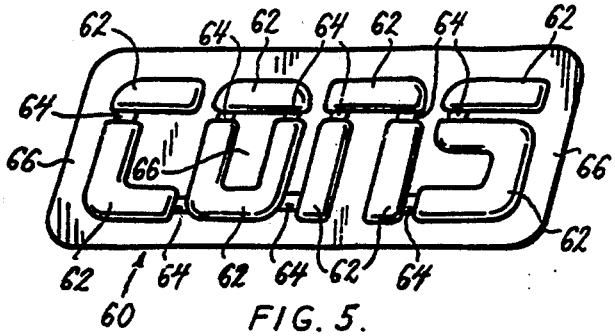
FIG. 5.

FLUID FILLED AMUSEMENT OR ATTENTION ATTRACTING ARTICLE FOR ATTACHMENT TO FOOTWEAR

BACKGROUND OF THE INVENTION (1) Field of the Invention

The present invention relates to a fluid filled amusement or attention attracting article for attachment to the exterior of shoes. In particular, the present invention relates to an amusement or attention attracting article comprised of a plurality of flexible, fluid filled chambers, where the fluid contained in the chambers is visible through transparent sidewalls of the chambers. The chambers are interconnected in fluid communication by fluid conduits and the chambers and the conduits are constructed to be secured to the exterior surface of a shoe. The sidewalls of the fluid chambers are touch sensitive and flex when manually manipulated. Manual manipulation of the sidewalls causes the fluid contained in the chambers to flow back and forth between the chambers. Amusement is derived from viewing the flow of fluid between the chambers and from sensing the flow of the fluid by touching the sidewalls of the chambers. The fluid filling the chambers may be brightly colored, reflective, fluorescent or luminescent, to increase the visibility of the chambers. The reflective, fluorescent or luminescent fluid filling the chambers is visible through the transparent sidewalls of the article and directs or attracts attention to the chambers. The enhanced visibility of the chambers when attached to the exterior of shoes serves to attract the attention of motorists to the presence of pedestrians or joggers wearing the shoes.

(2) Description of the Related Art

In prior art shoes, in particular athletic shoes used for walking or jogging, the exterior surfaces of many shoes are provided with designs and shapes of various different colors. In many prior art applications, the designs and shapes represent the trade designations or trademarks of the particular manufacturer of the shoes. In some applications, additional brightly colored designs and shapes are provided on the exterior surfaces of the shoes to enhance the ability of the shoes to be seen from a distance. The brightly colored designs and shapes are added for safety considerations. For example, to enhance the ability of the shoes of a pedestrian or jogger to be seen by motorists when crossing roadways or when walking or jogging near roadways.

It is an object of the present invention to provide an article that is added to the exterior surface of shoes that serves both to attract attention to the shoes and enhance their ability to be seen from a distance, and also provides a source of amusement on the shoes for manipulation and operation by the shoe wearer.

SUMMARY OF THE INVENTION

The fluid filled amusement or attention attracting article of the present invention is constructed to be attached to the exterior of shoes. The article is basically comprised of one or a plurality of fluid filled chambers interconnected in fluid communication by a plurality of conduits. The chambers of the article are constructed of a flexible, transparent, elastomeric material. The chambers can be formed in a wide variety of configurations. The interior volumes of the chambers, and the fluid conduits communicating the chambers, are filled with a fluid. The fluid may be a liquid, a liquid with bubbles suspended therein, or a composite fluid comprising a transparent liquid and a plurality of particles or hollow spheres suspended in the liquid. Manual manipulation of the flexible sidewalls of the fluid chambers causes the fluid contained in the chambers to flow from one chamber to another through the fluid conduits. Amusement is derived by manually manipulating the chamber sidewalls and causing the fluid to flow through the chambers and the conduits, and by viewing and feeling the flow of fluid through the chambers and conduits.

The article of the invention is specifically designed to facilitate its attachment to the exterior surface of a shoe. The article, and its chambers, are designed to enable the article to be secured between adjacent layers of material that form the component parts of a shoe. The article may also be secured to a patch that is attached over an exterior surface of a shoe, or may be made a part of a tag that is attached to the lacing or other parts of a shoe.

In securing the article between adjacent layers of material of a shoe, the exterior material of the shoe is provided with one or more holes having configurations that complement the configurations of the chambers of the article. The article is positioned behind the exterior layer of shoe material so that the flexible sidewalls of each chamber project through one of the holes provided through the shoe material. The exterior layer is then secured to a backing layer of shoe material with the article secured therebetween. In this manner, the article is secured to the exterior surface of the shoe with the flexible sidewalls of the chambers projecting through the holes provided in the shoe material. The projection or extension of the sidewalls through the holes enables the fluid filling the chambers to be seen through the transparent sidewalls, and also provides access to the sidewalls to enable their manual manipulation to cause the fluid to flow through the chambers.

The fluid filling each of the plurality of chambers may be brightly colored, fluorescent or luminescent. The bright colors of the fluid are visible through the transparent sidewalls of the fluid chambers projecting through the holes in the exterior surface of the shoe. The bright colors of the fluid enhance the ability of the shoe to be seen from a distance and thereby enhance the ability of motorists to see pedestrians or joggers wearing the shoes.

BRIEF DESCRIPTION OF THE DRAWINGS

Further objects and features of the present invention are revealed in the following description of the preferred embodiment of the invention and in the drawing figures wherein:

FIG. 1 is a perspective view of a shoe bearing the article of the present invention;

FIGS. 2 and 2A are perspective views of tags bearing the article of the present invention;

FIG. 3 is a plan view of a first embodiment of the article of the present invention;

FIG. 4 is a side elevation view, in section, of the first embodiment of the invention taken along the line 4—4 of FIG. 3;

FIG. 5 is a plan view of a variant embodiment of the article of the invention;

FIG. 6 is a plan view of a variant embodiment of the article of the invention;

FIG. 7 is a plan view of a variant embodiment of the article of the invention; and FIG. 8 is a plan view of the bottom of a shoe sole mounting the first embodiment of the article of the invention.

DESCRIPTION OF THE PREFERRED EMBODIMENT

The amusement or attention attracting article 10 of the present invention is shown in FIG. 1 in an operative environment of the invention secured in various positions to the exterior surface of a shoe 12. In the preferred embodiment of the invention, the article 10 is attached to an athletic shoe 12. However, the article of the invention is equally adapted for attachment to shoes other than the athletic shoe shown, and its description of being employed with an athletic shoe is illustrative only and should not be interpreted as limiting.

The first embodiment of the amusement or attention attracting article 10 of the present invention, removed from the shoe exterior surface, is shown in FIGS. 3 and 4 of the drawings. In this embodiment of the article, the article 10 is comprised of a first chamber 14 and a second chamber 16 interconnected in fluid communication by a fluid conducting conduit 18. However, in the embodiment of the article shown in FIGS. 3 and 4, and in the embodiments of the article yet to be described, the fluid conduit(s) 18 may be eliminated and the articles may be comprised of separate fluid chambers. As seen in FIG. 4, the article 10 is constructed from overlapping layers 20, 22 of a fluid tight, plastic, elastomeric material. Preferably both the top and bottom layers 20, 22 of the material are flexible and transparent. The top layer 20 of the article 10 has a predetermined surface configuration molded into it, where the bottom layer 22 is substantially flat. As seen in the drawing figures, the top layer is formed in a non-planar configuration with a central portion of the top layer being surrounded by a peripheral portion of the top layer that connects the top layer central portion to the bottom layer and spaces the central portion from the bottom layer with a void therebetween, thereby forming the interior volume of the chamber in the void between the top and bottom layers. The top layer has a molded configuration where the top layer peripheral portion is molded at an angle relative to the top layer central portion. The top layer peripheral portion is secured to the bottom layer and spaces the top layer central portion from the bottom layer with the void therebetween. The configuration of the shapes molded into the top layer form the two chambers 14, 16 and the conduit 18 when the top layer 20 is secured to the bottom layer 22 in the relative positions of the two layers shown in FIG. 4. The two triangular shapes formed in the top layer serve as flexible sidewalls 15, 17 of the two chambers 14, 16, respectively. The shapes may be molded into the top layer by any known method. The particular triangular shapes molded into the top layer 20 are illustrative only, and the chambers may be given a variety of other configurations, a few of which will be described later.

The top and bottom layers 20, 22 are secured together along a sealed flange 24 that completely surrounds and defines the borders of the first and second chambers 14, 16 and the fluid conduit 18. The top and bottom layers may be sealed together in the area of the flange 24 by adhesives, by radio frequency (RF) welding, or by other equivalent methods.

Each of the chambers 14, 16 formed between the pair of layers 20, 22 encloses an interior volume 26, 28, respectively. A fluid 30 fills the two interior volumes 26, 28 and flows between the interior volumes through the fluid conduit 18. In the preferred embodiment of the article, the fluid 30 is a composite fluid comprised of a transparent liquid and a plurality of particles suspended in the liquid. The suspended particles may be solid particles and may be reflective like metal flake, used in the fluid for appearances only, or the particles may be bubbles or small hollow spheres suspended in the liquid to displace some of the liquid filling the two interior chambers and reduce the overall weight of the liquid. In still further variant embodiments of the invention, the liquid may be reflective, fluorescent or luminous.

The sidewalls 15, 17 of the chambers formed in the top layer 20 are touch sensitive and flexible due to the flexibility of the material employed in constructing the top and bottom layers. On touching or manually manipulating the top layer 20 or sidewall 15 of the first chamber 14, the sidewall 15 will flex causing a change in the interior volume 26 of the first chamber. The change in the interior volume 26 will cause a portion the fluid 30 contained in the article to flow from the first chamber interior volume 26, through the conduit 18, to the second chamber interior volume 28. In the same manner, on touching or manually manipulating the top layer 20 or sidewall 17 of the second chamber 16, the interior volume 28 of the second chamber will change. The change in the interior volume 28 of the second chamber will cause a portion of fluid 30 contained in the second chamber interior volume 28 to flow through the fluid conduit 18 into the interior volume 26 of the first chamber. By successively manipulating or depressing the sidewalls 15, 17 sealing over the respective first and second chambers 14, 16, the fluid 30 filling the chambers is caused to flow back and forth between the respective interior volumes 26, 28 through the fluid conduit 18. By constructing the top layer 20 of a transparent flexible material, the flow of fluid between the two interior chambers 26, 28 can be felt by touching the sidewalls 15, 17 and observed through the sidewalls.

By securing the article of the invention 10 to the exterior surface of a shoe as shown in FIG. 1, the article of the invention 10 provides a close at hand source of amusement that is manually manipulated by successively depressing the sidewalls 15, 17 of the two chambers 14, 16. Amusement is derived by observing the flow of fluid back and forth between the interior volumes 26, 28 through the transparent sidewalls 15, 17 of the two respective chambers, and in sensing the flow of fluid back and forth between the interior volumes by touching the sidewalls 15, 17 covering over the two volumes.

By filling the two interior volumes 26, 28 with a fluid 30 that is reflective, fluorescent or luminous, the articles 10, when secured to the exterior surfaces of shoes 12, also serve as safety devices that increase the ability of motorists to see pedestrians or joggers wearing the shoes. The reflective, fluorescent or luminescent fluid filling the chambers is visible through the transparent sidewalls 15, 17 of the article and directs or attracts attention to the shoes of a pedestrian or jogger, making them more visible to motorists. In embodiments of the article where only brightly colored fluid 30 is employed in the chambers, the bright color of the fluid contrasted with the color of the shoes 12 will also call attention to the shoes and attract the attention of motorists to the presence of a pedestrian or jogger.

The fluid filled article 10 of the present invention is secured to the exterior surface of a shoe 12 in a variety of ways. In the operative environment of the invention shown in FIG. 1, the article 10 is shown secured on the tongue 34 of the shoe, a padded ankle collar 36 of the shoe, a fastening strap 38 of the shoe, and in the sole 40 of the shoe. The positions of the article 10 on the shoe 12 shown in FIG. 1 are illustrative only and should not be interpreted as limiting. The article 10 may be secured in virtually any desired position on the shoe, for example on the heel counter of the shoe.

In the tongue 34, collar 36, and fastening strap 38 of the shoe, the article 10 is secured to the shoe in substantially the same manner. In shoe construction, it is common for the upper portion of the shoe to be constructed of overlapping layers of material, an interior layer and an exterior layer. In each of the applications of the invention referred to above, the article 10 of the invention is secured between overlapping layers of the material employed in constructing the shoe, or between the exterior layer of the shoe material and a separate patch of material secured over the exterior of the shoe. In both methods, a section of the material employed in constructing the different component parts of the shoe, or a separate patch of material, is provided with at least one aperture or hole having a configuration identical to the configuration of the two fluid filled chambers 14, 16 and the connecting conduit 18 of the article of the invention. The section of shoe material, or the separate patch, is positioned over the article of the invention 10 so that it covers over the sealed flange 24 of the article, but the flexible sidewalls 15, 17 of the first and second chambers 14, 16 and the fluid conduit 18 project through and are bounded by the hole cut through the material or patch. If so desired, the exterior layer of shoe material or the patch may be constructed with two or more apertures or holes, each for one of the chambers of the article. In this variant embodiment, the shoe material or separate patch is positioned over the article of the invention 10 so that it covers over the sealed flange 24 and fluid conduit 18, but the flexible sidewalls 15, 17 project through the holes. The exterior layer of shoe material is adhered or sewn to a backing interior layer of the shoe material, with the article of the invention 10 secured therebetween. Alternatively, the separate patch is secured by adhesives or sewn stitches to the exterior surface of the shoe with the article 10 secured between the patch and the exterior shoe surface.

For example, in constructing the tongue 34 of the shoe shown in FIG. 1, the tongue is formed of an exterior and interior layer of material. The exterior layer of the material is provided with the aperture or hole 42 for accommodating the first and second chambers 14, 16 and the conduit 18 of the article of the invention. The article is positioned behind the exterior layer and the flexible sidewalls 15, 17 of the first and second chambers 14, 16 and the conduit 18 are positioned projecting through the hole 42 cut in the exterior layer. The interior layer of the tongue material is then positioned behind the exterior layer of the tongue material with the article of the invention 10 sandwiched therebetween. The exterior and interior layers of the tongue material are then adhered or stitched together to secure the article 10 between the two layers with the first and second chambers 14, 16 and the conduit 18 of the article projecting through the hole provided in the exterior layer. In stitching the two layers together, the stitching is also preferably passed through the sealed flange 24 surrounding the first and second chambers 14, 16 and the conduit 18 to secure the article in position inside the shoe tongue. The article of the invention 10 may be secured in the fastener strap 38 in the same manner. The article is positioned between overlapping layers of shoe strap material with the sidewalls 15, 17 of the fluid chambers 14, 16 and the conduit 18 projecting through a hole provided through the top layer of the strap material. The top and bottom layers are then stitched together with the article 10 secured therebetween.

The article of the invention 10 may be secured in the shoe collar 36 in substantially the same manner as described above with reference to the shoe tongue 34 and fastener strap 38. Like the construction of the shoe tongue, the shoe collar 36 is formed of an exterior and interior layer of material. The exterior layer of material is provided with a pair of holes 43 for accommodating the first and second chambers 14, 16 of the article of the invention. The portion of collar material remaining between the pair of holes is left to cover over the conduit 18 so that the conduit is not visible from the exterior of the shoe. The article 10 is positioned behind the exterior layer and the flexible sidewalls 15, 17 of the first and second chambers are positioned projecting through the pair of holes 43 cut into the exterior layer of collar material. The interior layer of the collar material is then positioned behind the exterior layer of material with the article of the invention 10 sandwiched therebetween. The exterior and interior layers of the collar material are then adhered or stitched together to secure the article 10 between the two layers with the first and second chambers 14, 16 of the article projecting through the holes 43 provided in the exterior layer. In stitching the two layers together, the stitching is also preferably passed through the sealed flange 24 surrounding the first and second chambers 14, 16 to secure the article in position inside the shoe collar. In a variant embodiment of the article 10 to be employed with a portion of the shoe material covering over the conduit 18, the bottom layer 22 of the article may be formed with the conduit 18 molded into it, the two chambers 14, 16 still being molded into the top layer 20. With the conduit molded into the bottom layer 22 of the article, the portion of the top layer 20 between the two chambers 14, 16 will lie in the same plane as the flange 24 surrounding the chambers. This will enable the exterior layer of shoe material having two apertures cut therein to be laid over the top layer 20 of the article with the layer of shoe material lying flat over the flange 24 and the portion of the top layer 20 between the two chambers 14, 16.

To secure the article 10 in a shoe sole formed of a synthetic rubber or elastomeric material as shown in FIG. 1, a mold for forming the shoe sole is specially constructed. The mold is constructed to form a shoe sole in the mold having a recess provided for the article 10 in the interior of the shoe sole. The recess is formed in the shoe sole adjacent an exterior side of the sole. The recess is formed having one or more apertures communicating with the exterior of the shoe sole. In the embodiment of the invention shown in FIG. 1, a pair of apertures are shown in the side of the shoe sole 40 communicating with a cavity in the interior of the shoe sole (not shown). The article of the invention is inserted into the cavity from the interior of the shoe sole and the flexible sidewalls 15, 17 of the two chambers 14, 16 project out through the pair of apertures in the side of the shoe sole. In the embodiment shown in FIG. 1, a portion of the exterior surface of the shoe sole 40 covers over the conduit 18 of the article. In variations of this embodiment, the aperture may be formed in the exterior surface of the shoe sole 40 having the configuration of the conduit 18 as well as the pair of chambers 14, 16. In this variant embodiment, the pair of chambers 14, 16 and the conduit 18 project out from the aperture provided in the side of the shoe sole 40. To secure the article 10 in its position projecting through the aperture of the shoe sole, the flange 24 is adhered to the interior of the shoe sole.

In a further variant of this embodiment of the invention, the article 10 may be molded directly in the bottom of the shoe sole 44 as shown in FIG. 8. Again, the shoe sole mold must be specially constructed to provide a recess in the interior of the molded shoe sole to receive and position the article 10 at the bottom of the shoe sole. In this embodiment of the invention, the flange 24 of the article is adhered to the interior of the shoe sole 44. The sidewalls 15, 17 of the fluid chambers 14, 16 project from a pair of apertures in the bottom of the shoe sole into a cavity 46 molded in the sole bottom for the fluid chambers. A transparent elastomeric material is then molded in the cavity 46 to seal over the first and second chambers 14, 16. The transparent elastomeric material is flexible so that by pressing the material on opposite sides of the cavity 46, a flow of fluid between the first and second chambers 14, 16 of the article can be observed.

In a still further embodiment of the invention shown in FIGS. 2 and 2A, the article 10 is secured in a patch or tag 47, 47' formed by overlapping layers of material. The patch or tag is formed from a front layer of material 48, 48' and a back layer of material 50, 50', and the article 10 is secured inside the patch or tag in much the same way as described earlier with regard to the tongue 34, collar 36, and strap 38 of the shoe 12. The front layer of material 48, 48' has either one hole 52' (FIG. 2A) or a pair of holes 52 (FIG. 2) cut therethrough. The hole 52' (FIG. 2A) has the general configuration of the first and second chambers 14, 16 and the connecting conduit 18. The holes 52 (FIG. 2) have the general configuration of the first and second chambers 14, 16 of the article 10.

In FIG. 2, the article 10 is positioned between the front and back layers 48, 50 with the sidewalls 15, 17 of the two chambers 14, 16 projecting through the pair of holes 52. The front and back layers of material 48, 50 are then secured together by adhesives or sewn stitching extending around the borders of the two layers of material. The article 10 is secured in position between the two layers by additional stitching that surrounds the two fluid chambers 14, 16 and extends through the flange 24 as well as the front and back layers 48, 50 of material. The patch or tag 47 is provided with a hole 54 at one corner for attachment of the patch or tag to the shoe by the lacing of the shoe or by some other form of tether to the shoe. When employed as a patch, the back layer of material 50 may be omitted and the front layer 48 may be secured directly to the exterior surface of the shoe with the article 10 therebetween.

The patch or tag 47' of FIG. 2A is substantially identical to that of FIG. 2 except that it only has one hole 52' in the front layer of tag material. Both fluid chambers 14, 16 and the conduit 18 project through the hole. The front layer 48' of the FIG. 2A embodiment is secured to the back layer 50' as a tag, or is secured to the shoe exterior as a patch, in the same manner as the FIG. 2 embodiment.

The article of the invention may be provided with a variety of different configurations other than that shown in FIGS. 1–4 and 8. In FIG. 5, the article of the invention 60 is shown having a plurality of fluid chambers 62 interconnected by fluid conduits 64. The fluid chambers 62 are arranged in a configuration representative of the trademark CONS of Converse Inc. This variant embodiment of the article of the present invention is constructed in the same manner as the embodiment described with reference to FIGS. 3 and 4 above. A top layer of flexible material is molded with the configurations of the chambers 62 and conduits 64 shown in FIG. 5. The top layer is then secured to a bottom layer by adhesives, radio frequency (RF) welding, or other equivalent methods, along the sealed flange 66. As seen in FIG. 5, the sealed flange 66 in this embodiment also includes areas of the two layers in between the chambers and conduits, not just surrounding the chambers and conduits. The chambers and conduits are filled with the fluid (not shown) described earlier with reference to FIGS. 3 and 4. It should be apparent that, with the conduits 64 connecting each of the separate fluid chambers 62, by manually manipulating one of the chambers 62 of the article 60, causing the flexible sidewall of the chamber to be depressed or flexed, the fluid contained in the interior volume of the chamber will be caused to flow through the conduits 64 to the other chambers 62. By constructing the article 60 of transparent top and bottom layers, the flow of fluid through the chambers 62 and conduits 64 can be observed. Moreover, by constructing the top and bottom layers of flexible material, the flow of fluid through the chambers 62 and conduits 64 can be sensed by touch. By arranging the plurality of chambers 62 of the article 60 in a representation of a shoe manufacturer's trademark, the article of the invention also calls attention to the trademark. Furthermore, if the shoe is so constructed that there is insufficient surface area on the shoe to attach embodiments of the invention such as the article of FIGS. 3 and 4, the article of the invention can be formed in the configuration of the manufacturer's trademark or logo and can be attached to the shoe in place of the usual trademark or logo appearing on the shoe.

The embodiment of the article 60 shown in FIG. 5 can be secured on the exterior surface of a shoe in substantially the same manner as described with reference to the embodiment of the invention shown in FIGS. 3 and 4. A top layer of the shoe material is provided with one or more holes therethrough. When a single hole is employed, the hole has the general configuration of all of the chambers 62 and conduits 64 of the article to enable all the chambers and conduits to project through the hole. When a plurality of holes are employed, each of the holes has the configuration of an individual chamber 62 to enable just the chambers to project through the holes. The article 60 is positioned behind the top layer of material with the chambers 62 and conduits 64, or just the chambers projecting through the hole or holes respectively, provided in the material. The top layer of material is then secured to a bottom layer of material with the article 60 therebetween by sewn stitching or other equivalent methods. The sewn stitching may be passed through the flange 66 surrounding the chambers 62 to secure the article 60 stationary relative to the hole or holes provided in the top layer of material. This embodiment of the article 60 may also be secured to the exterior of a shoe by a separate patch of material, and may also be secured inside a separate tag that is attached to the shoe. The manner in which the article 60 is secured by the patch or inside the tag is substantially the same as that described above with reference to FIGS. 1–4.

FIGS. 6 and 7 show two further variant embodiments of the article of the present invention. In the embodiment of the invention shown in FIG. 6, a first chamber 72 is formed in the configuration of the outline of a chevron and a second chamber 74 is formed in the configuration of an outline of a star. Together, the chevron and star shaped chambers form the logo for Converse Inc. The first and second chambers are interconnected in fluid communication by a fluid conduit 76. This embodiment of the invention is constructed in substantially the same manner as the previously described embodiments, with a top layer of transparent flexible material being formed with the configuration of the chevron outline and star outline and the conduit connecting the two outlines therein. The top layer and bottom layer are then secured together, sealing the interior volumes of the chevron 72 and star 74 shaped chambers therebetween. The interior volumes of the chevron chamber 72 and star chamber 74 are filled with the fluid. The chevron and star shaped chambers are surrounded by a flange 78 formed when the top and bottom layers are secured together.

This embodiment of the article of the invention is secured to the exterior surface of a shoe in the same manner as the previously described embodiments. A top layer of the shoe material is provided with a hole having substantially the same shape as the star and chevron chambers 74, 72, and the connecting conduit 76, or with holes having substantially the same shapes as the chevron 72 and star 74 chambers. The article 70 is positioned behind the top layer with the chevron, star and conduit projecting through the hole, or with the chevron and star chambers projecting through the holes. The top and bottom layers of the shoe material are then secured together by stitching, with stitching extending through the flange 78 to secure the chevron 72 and star 74 chambers in their relative positions projecting through the hole or holes in the top layer. This embodiment of the article may also be secured to a shoe surface by a separate patch and may also be secured inside a tag in the same manner described above with reference to the embodiment of FIGS. 1–4.

The embodiment of the article of the invention 80 shown in FIG. 7 is substantially identical to the embodiment of the invention shown and described with reference to FIGS. 3 and 4, except for the configuration of the first and second chambers 82, 84. As in the embodiment of FIGS. 3 and 4, the first and second chambers 82, 84 are connected in fluid communication by a fluid conduit 86. This embodiment of the invention is secured on the exterior surface of a shoe in substantially the same manner as that described earlier with reference to the embodiment of the invention shown in FIGS. 3 and 4.

While the present invention has been described by reference to specific embodiments, it should be understood that modifications and variations of the invention may be constructed without departing from the scope of the invention defined in the following claims.

What is claimed is:

1. A fluid filled amusement or attention attracting article attached to footwear, the article comprising:

at least one hollow chamber being formed with overlapping top and bottom layers of material and with an interior volume of the chamber sealed between the top and bottom layers, the bottom layer being generally planar to conform to a surface area of the footwear to which it is attached, the top layer being flexible and being formed in a non-planar configuration with a central portion of the top layer being surrounded by a peripheral portion of the top layer that is connected to the bottom layer and spaces the central portion of the top layer from the bottom layer with a void therebetween, thereby forming the interior volume of the chamber in the void between the top and bottom layers;

a fluid filling the interior volume of the chamber, portions of the fluid being caused to flow from one area of the chamber interior volume to another area of the chamber interior volume in response to flexing of the top layer of the chamber; and means for securing the chamber to a surface of the footwear where the chamber is visible and accessible.

2. The article of claim 1, wherein:

the configuration of the top layer includes a flange that surrounds the peripheral portion of the top layer, the flange is generally planar and the peripheral portion spaces the central portion from a plane generally defined by the flange, and the flange connects the peripheral portion of the top layer to the bottom layer.

3. The article of claim 2, wherein:

the means for securing the chamber to a surface of the footwear includes the flange surrounding the peripheral portion of the top layer being sewn to an exterior surface of the footwear.

4. The article of claim 2, wherein:

the means for securing the chamber to a surface of the footwear includes the flange surrounding the peripheral portion of the top layer being positioned beneath and secured to an exterior surface of the footwear with the peripheral portion of the top layer projecting through a hole in the exterior surface and spacing the central portion of the top layer above the exterior surface.

5. The article of claim 2, wherein:

the means for securing the chamber to a surface of the footwear includes a patch comprised of overlapping front and back layers of flexible material, the patch being separate from the footwear, the flange surrounding the peripheral portion of the top layer being positioned behind the front layer of the patch with the peripheral portion of the top layer projecting through a hole in the front layer of the patch and spacing the central portion of the top layer from the patch front layer, the patch back layer being secured to the front layer with the flange sandwiched therebetween thereby forming the patch, and means attaching the patch to the footwear.

6. The article of claim 2, wherein:

a plurality of hollow chambers including the one hollow chamber are formed between the overlapping top and bottom layers of material with each chamber having an interior volume sealed between the top and bottom layers, the top layer being formed with a plurality of central portions each surrounded by a peripheral portion of the top layer that is connected to the bottom layer and spaces the surrounded central portion from the bottom layer with a void therebetween, thereby forming the interior volumes of the chambers in the voids between the top and bottom layers;

the fluid filling the interior volume of each chamber, portions of the fluid being caused to flow from one area of each chamber interior volume to another area of a chamber interior volume in response to flexing of the top layer of a chamber; and means for securing the plurality of chambers to a surface of the footwear where the chambers are visible and accessible.

7. The article of claim 6, wherein:

a plurality of fluid conducting conduits are formed in the top layer interconnecting the plurality of chambers in fluid communication with each other, the plurality of conduits enabling portions of the fluid to flow between interior volumes of chambers of the plurality of chambers in response to flexing of the layers of the chambers.

8. The article of claim 1, wherein:

the top layer of material is transparent and the fluid filling the interior volume is visible through the top layer.

9. The article of claim 1, wherein:

the means for securing the chamber to a surface of the footwear includes an adhesive applied to the bottom layer, the adhesive securing the bottom layer to an exterior surface of the footwear with the peripheral portion of the top layer spacing the central portion of the top layer out from the surface of the footwear.

10. The article of claim 1, wherein:

the chamber is shaped in a configuration representative of a trademark.

11. A fluid filled amusement or attention attracting article attached to footwear, the article comprising:

a plurality of fluid filled chambers, each chamber of the plurality being formed from overlapping top and bottom layers of material and with an interior volume of each chamber being sealed between the top and bottom layers, the bottom layer being generally planar to conform to a surface area of the footwear to which it is attached, the top layer being flexible and being formed in a non-planar configuration with a plurality of central portions each surrounded by a peripheral portion of the top layer that is connected to the bottom layer and spaces the surrounded central portion of the top layer from the bottom layer with a void therebetween, thereby forming the interior volumes of the plurality of chambers in the voids between the top and bottom layers;

a fluid filling the interior volumes of the chambers, portions of the fluid being caused to flow from one area of each chamber interior volume to another area of a chamber interior volume in response to flexing of the top layer of the chamber; and means for securing the plurality of chambers to a surface of the footwear where the plurality of chambers are visible and accessible.

12. The article of claim 11, wherein:

at least one fluid conducting conduit is formed in the top layer interconnecting the plurality of chambers in fluid communication, the conduit enabling portions of the fluid to flow between interior volumes of chambers of the plurality of chambers in response to flexing of the layers of the chambers, the conduit having a cross-sectional area that is smaller than a cross-sectional area of the chambers connected in fluid communication by the conduit thereby limiting a rate of fluid flow through the conduit between the chambers.

13. The article of claim 11, wherein:

the top layer of material is transparent and the fluid filling the interior volumes of the plurality of chambers is visible through the top layer.

14. The article of claim 11, wherein:

the means for securing the plurality of chambers to a surface of the footwear includes an adhesive applied to the bottom layer, the adhesive securing the bottom layer to an exterior surface of the footwear with the peripheral portions of the top layer spacing the central portions of the top layer out from the surface of the footwear.

15. The article of claim 11, wherein:

the configuration of the top layer includes a flange that generally surrounds each of the peripheral portions of the plurality of chambers, the flange is generally planar and parallel to the bottom layer and each of the top layer peripheral portions space the top layer central portions from a plane generally defined by the flange, and the flange connects the top layer peripheral portions to the bottom layer.

16. The article of claim 15, wherein:

the means for securing the plurality of chambers to a surface of the footwear includes the flange surrounding the top layer peripheral portions of the chambers being sewn to an exterior surface of the footwear with the top layer peripheral portions spacing the top layer central portions above the exterior surface of the footwear where they are accessible.

17. The article of claim 15, wherein:

the means for securing the plurality of chambers to a surface of the footwear includes the flange surrounding the top layer peripheral portions of the chambers being positioned beneath and secured to an exterior surface of the footwear with the top layer peripheral portions of each chamber projecting through one of a plurality of holes in the exterior surface and spacing the top layer central portion of each chamber above the exterior surface of the footwear where they are accessible.

18. The article of claim 15, wherein:

the means for securing the plurality of chambers to a surface of the footwear includes a patch comprised of overlapping front and back layers of flexible material, the patch is separate from the footwear and the flange surrounding the top layer peripheral portions of the chambers is positioned behind the patch front layer with the top layer peripheral portion of each chamber projecting through one of a plurality of holes in the front layer and spacing the top layer central portion of each chamber out from the front layer of the patch, the patch back layer being secured to the front layer with the flange sandwiched therebetween, thereby forming the patch, and means attaching the patch to the footwear.

19. The article of claim 11, wherein:

the plurality of chambers are arranged in a configuration of a trademark.

20. A fluid filled amusement or attention attracting article attached to footwear, the article comprising:

at least one hollow chamber being formed with overlapping top and bottom layers of flexible material and with an interior volume of the chamber sealed between the top and bottom layers, the bottom layer being generally planar to conform to a surface area of the footwear to which it is attached, the top layer being formed in a non-planar configuration with a central portion of the top layer being spaced from the bottom layer with a void therebetween, thereby forming the interior volume of the chamber in the void between the top and bottom layers;

a fluid filling the interior volume of the chamber, portions of the fluid being caused to flow from one area of the chamber interior volume to another area of the chamber interior volume in response to flexing of the layers of the chamber; and means for securing the chamber to a surface of the footwear where the chamber is visible and accessible for manual manipulation and flexing of the chamber top layer, and where the fluid in the chamber is not subjected to compression forces due to footstep impact of the footwear.

21. The article of claim 20, wherein:

the top layer is formed with a central portion of the top layer being surrounded by a peripheral portion of the top layer that is connected to the bottom layer and spaces the top layer central portion from the bottom layer with a void therebetween, thereby forming the interior volume of the chamber in the void between the top and bottom layers.

22. The article of claim 21, wherein:

the top layer has a molded configuration where the top layer peripheral portion is molded at an angle relative to the top layer central portion and the top layer peripheral portion is secured to the bottom layer and spaces the top layer central portion from the bottom layer with the void therebetween, thereby forming the interior volume of the chamber.

23. The article of claim 22, wherein:

the means for securing the chamber to a surface of the footwear includes the chamber being positioned beneath an exterior surface of the footwear with the top layer peripheral portion projecting through a hole in the exterior surface and spacing the top layer central portion above the exterior surface where it is accessible for manual manipulation and flexing.

24. The article of claim 22, wherein:

the means for securing the chamber to a surface of the footwear includes a patch comprised of overlapping front and back layers of flexible material, the patch is separate from the footwear and the top layer peripheral portion of the chamber is positioned behind the patch front layer with the peripheral portion projecting through a hole in the front layer and spacing the top layer central portion out from the front layer, the patch back layer being secured to the front layer with the chamber sandwiched therebetween, thereby forming the patch, and means attaching the patch to the footwear.

25. The article of claim 20, wherein:

the chamber is shaped in a configuration representative of a trademark.

* * * * *